US006178976B1

(12) United States Patent
Lordo

(10) Patent No.: US 6,178,976 B1
(45) Date of Patent: Jan. 30, 2001

(54) PICKLE TANK COVER WITH PLENUM CHAMBER

(75) Inventor: Richard K. Lordo, Hermitage, PA (US)

(73) Assignee: Danieli Technology, Inc., Cranberry Township, PA (US)

( * ) Notice: Under 35 U.S.C. 154(b), the term of this patent shall be extended for 0 days.

(21) Appl. No.: 09/255,241

(22) Filed: Feb. 22, 1999

(51) Int. Cl.[7] ..... B08B 15/02

(52) U.S. Cl. ..... 134/64 R; 134/122 R; 134/201; 134/182; 454/67

(58) Field of Search ..... 134/64 R, 122 R, 134/182, 201, 82, 64 P, 122 P; 454/67

(56) References Cited

U.S. PATENT DOCUMENTS

| | | | | |
|---|---|---|---|---|
| 1,525,483 | * | 2/1925 | White | 454/67 |
| 2,121,139 | * | 6/1938 | Clauss et al. | 134/64 R |
| 2,650,599 | * | 9/1953 | Campbell | 134/64 R |
| 3,516,345 | * | 6/1970 | Meyer | 134/64 R |
| 3,543,775 | * | 12/1970 | Bodnar | 134/64 R |
| 3,648,593 | | 3/1972 | Marshall | 98/115 R |
| 3,803,996 | | 4/1974 | Marshall | 98/115 R |
| 4,592,784 | | 6/1986 | Ghizzi | 134/15 |
| 4,604,157 | | 8/1986 | Damiron et al. | 156/345 |
| 4,850,378 | * | 7/1989 | Mattiussi | 134/64 R |
| 4,928,717 | | 5/1990 | Osarek et al. | 134/64 R |
| 5,118,357 | * | 6/1992 | Sabatka | 134/64 R |
| 5,188,135 | * | 2/1993 | Neumann et al. | 134/64 R |
| 5,205,303 | * | 4/1993 | Gileta | 134/122 R |
| 5,240,018 | * | 8/1993 | Clark et al. | 134/64 R |
| 5,248,372 | | 9/1993 | McNamee | 156/345 |
| 5,282,485 | | 2/1994 | Hirai et al. | 134/64 R |
| 5,454,388 | | 10/1995 | Glaiman et al. | 134/64 R |
| 5,566,694 | | 10/1996 | Pugh et al. | 134/64 R |
| 5,634,845 | * | 6/1997 | Diachunk | 494/67 |

FOREIGN PATENT DOCUMENTS

| | | | | |
|---|---|---|---|---|
| 1112682 | * | 8/1961 | (DE) | 134/122 R |
| 2415151 | * | 9/1979 | (FR) | 134/64 R |
| 46-11561 | * | 7/1971 | (JP) | 134/64 R |

* cited by examiner

*Primary Examiner*—Frankie L. Stinson
(74) *Attorney, Agent, or Firm*—Armstrong, Westerman, Hattori, McLeland & Naughton

(57) ABSTRACT

A tank cover made of a plurality of sections, which when connected, form a continuous tank cover enclosing the pickle tank. The tank cover is constructed of a plurality of exhaust sections each having an exhaust outlet and a plurality of sections having a plenum chamber which adjoin each other and the exhaust sections. The sections of the tank cover having the plenum chamber have an internal chamber for collecting evaporated acid fumes and transporting these fumes to exhaust outlets connected to the exhaust sections where the fumes may be discharged to an external scrubber.

13 Claims, 3 Drawing Sheets

PICKLE TANK COVER WITH PLENUM CHAMBER

FIELD OF THE INVENTION

The present invention relates generally to a cover assembly for metal pickling tanks and more specifically to a cover assembly which has as a part thereof a means for collecting and exhausting toxic and corrosive fumes released from a picking line.

BACKGROUND OF THE INVENTION

Pickling is the process of chemically removing oxides and scale from the surface of a metal by the action of water solutions of inorganic acids. The reaction occurring when steel or iron materials are immersed in dilute inorganic acid solutions includes the solution of metal as a salt of the acid and the evolution of hydrogen. Steel pickled in dilute hydrochloric acid and sulfuric-acid solutions is an example of this reaction, with the end products of reaction being, respectively, ferrous chloride and hydrogen and ferrous sulfate and hydrogen. Adherent films of oxides are removed by the acid attack upon the scale on the base metal.

The pickling zone for pickling metal usually consists of several individual acid-proof tanks, typically about two to three feet in depth, located in series, comprising an effective immersion length of about 250 to 300 feet. While many lines have from three to five tanks, each about 40 to 80 feet long, some lines have only one long tank, divided by weirs into four or five sections. The strip is completely submerged under several inches of liquid acid bath as it travels through the tank or series of tanks forming the pickling zone.

The rate of pickling metal in the pickling zone is affected by numerous variables, including the metal-based constituents and the type and adherence of oxide to be removed. Solution temperature and concentration, ferrous chloride or ferrous sulfate concentration, agitation, time of immersion and presence of inhibitors all influence the rate of acid attack. Rate of acid attack and tank efficiency are important considerations when choosing operational parameters such as the choice of acid, hydrochloric acid or sulfuric acid for example, and the temperature of the acid bath. One of the most common efficiency problems in today's pickling systems is heat loss from the acid baths. The loss of heat lowers the efficiency of the overall system and will be more costly to operate.

Much of the heat supplied to the acid baths in pickling operations is lost at the surface of the acid bath by liquid evaporation. The heated acid bath solution evaporates into the air space between the acid bath and a cover enclosing the tank from the outside. In conventional pickling systems, the space above the acid bath and below the tank cover is used for transporting exhaust gases, evaporated acid bath fumes and air, to exhaust exits connected to the tank cover. Thus, the exhaust gasses in this space are not static, but form a fluid stream that typically flows in one direction, discharging through the exhaust exits. The contact of this fluid stream, traveling just above the acid bath surface, with the bath increases the evaporation rate at the air-liquid interface of the bath.

Increased evaporation leads to increased heat loss which means that more heat must be supplied to the acid baths in order to maintain the acid baths at a constant temperature. Maintaining the acid baths at a constant temperature is important in achieving even pickling of a length of metal product. By maintaining a specific acid temperature, the pickling process can either be sped up or slowed down to achieve the proper pickling of a product. But heat loss from the acid bath can complicate the pickling process by creating temperature gradients in the acid baths which can cause uneven pickling of the metal product.

In many present designs, the surface of the acid bath is open to the circulation exhaust gases from the pickling system. This facilitates heat loss. Because most of the heat loss of the acid is from the surface of the liquid in the form of evaporation, it is important to control this loss.

OBJECTS OF THE INVENTION

It is an object of the present invention to overcome the above disadvantages, and in particular to provide a pickle tank cover which minimizes heat loss and improves the efficiency of the pickling operation.

It is another object of the present invention to provide a cover assembly and fume collection system which is resistant to high temperature corrosive acid fumes.

It is yet another object of the present invention to provide fume removal at specific locations along the pickling tank for minimal heat loss of pickling acid bath.

It is still another object of the present invention to provide a tank cover that transports air and fumes so the moving air does not substantially contact the liquid surface of the acid bath of the pickling tank.

It is again another object of the present invention to capture escaping fumes at the inlet and exit openings of the pickling tanks where the metal strip enters and exits the pickle tanks and where the covers join.

It is a further object of the present invention to provide a fume exhaust system that is balanced.

It is still a further object of the present invention to provide an improved method for pickling a length of metal strip.

Finally, it is an object of the present invention to provide tank covers such that air is pulled from outside of the pickle tanks to form an air curtain around the entry and exit points to prevent fumes from escaping from the pickle tanks.

Other objects, features and advantages of the present invention will become apparent from the following detailed description taken in conjunction with the accompanying drawings.

SUMMARY OF THE INVENTION

The present invention is a tank cover for a pickling operation which can improve the efficiency of the metal pickling operation and can overcome the disadvantages of prior art tank covers. It can also reduce the costs of the pickling operation. Specifically, the tank cover of the present invention reduces the heat lost from the pickling system and minimizes escape gases from the system by improving the flow of air and exhaust gases through the pickling system.

To the end of minimizing heat loss and achieving efficiency, the tank cover of the present invention separates the surface of the acid baths in the pickle tanks from exhaust gas flow through the pickling system. This separation reduces the acid evaporation rate which reduces heat loss and provides for a more efficient control over the exhaust gases.

A typical tank cover of the present invention extends the length of the pickle tank from the metal strip inlet to metal strip outlet at the opposite end of the pickle tank. Preferably the tank cover is made of a plurality of sections, which when connected, form a continuous cover enclosing the pickle tank. Specifically, the tank cover is constructed of a plurality of exhaust sections each having an exhaust outlet which is stationary and a plurality of sections which are movable. The sections which are movable can be opened for access to the inside of the tank if required for maintenance. The plurality of sections which are movable have a plenum chamber, which adjoin each other and the exhaust sections. Furthermore, the tank cover of the present invention is preferably constructed so that the exhaust sections form the entrance and exit of the pickling system in addition to being spaced evenly along tank cover between the sections having the plenum chamber.

The sections of the tank cover having the plenum chamber have an internal plenum chamber for collecting evaporated acid fumes and transporting these fumes to exhaust outlets connected to the exhaust sections. The separate collection and transportation of exhaust gases in the plenum chamber does not disturb the air-liquid interface of the acid bath, thereby reducing the evaporation rate. Once exhaust fumes have entered the plenum chamber, the fumes are transported to the exhaust outlet sections along the pickle tank cover where they are sent to a scrubber. Air velocities may be increased in the plenum chamber without concern for heat loss of the fluid in the pickle tanks because the fumes are not in contact with the fluid surface in the tanks.

Not only does the tank cover of the present invention minimize heat loss from the pickling tanks but it minimizes escape gases from the system. Air flow ducts are attached to the tank cover of the present invention at the entrance and exit of the pickle tank to capture most escaping gasses. This is another way heat is conserved and the efficiency of the system is improved as compared to prior art systems.

DETAILED DESCRIPTION OF THE INVENTION

Figure 1:
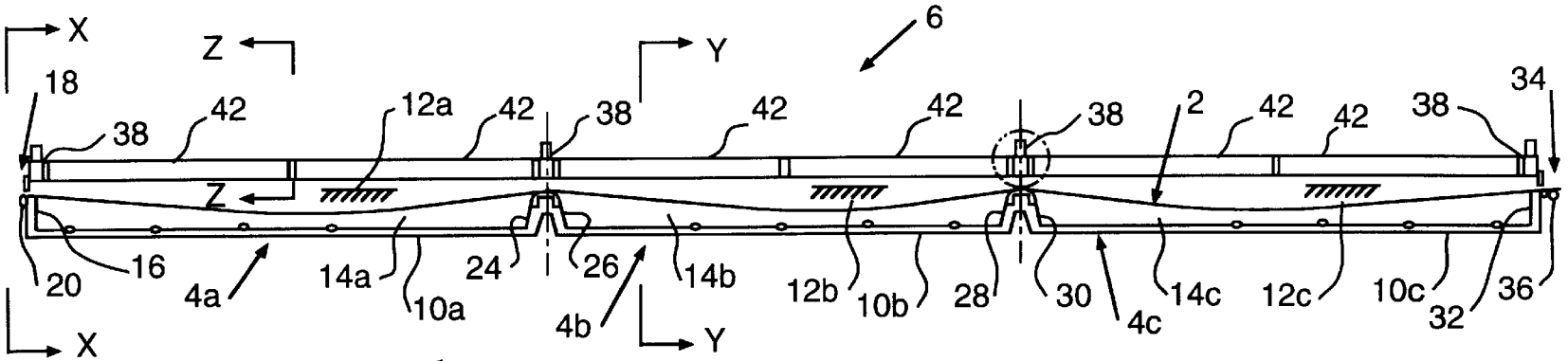
FIG. 1 is a schematic view, in cross-section, of three pickle tanks aligned in series covered by one embodiment of a tank cover of the present invention.

There is shown in FIG. 1 a continuous single length of steel 2 that is being pickled in an acid bath in pickle tank 4 enclosed by a tank cover 6 which is the preferred embodiment of a tank cover of the present invention. Tank cover 6 reduces the cost and improves the efficiency of the steel pickling operation. Tank cover 6 reduces the heat lost from the pickling system, consisting of pickle tank 4, tank cover 6 and the acid bath, and minimizes escape gases from the system by improving the flow of air and exhaust gases through the pickling system. The pickling of a length of steel 2 is exemplary, as tank cover 6 of the present invention is suitable for covering a tank for pickling any metal product.

Much of the heat supplied to the acid baths in pickling operations in is lost at the surface of the acid bath by liquid evaporation. The heated acid bath solution evaporates into the air space between the acid bath and the tank cover. In conventional pickling systems, the space above the acid bath and below the tank cover is used for transporting exhaust gases, evaporated acid bath fumes and air, to exhaust exits connected to the tank cover. Thus, the exhaust gasses in this space are not static, but form a fluid stream that typically flows in one direction, discharging through the exhaust exits. The contact of this fluid stream with the acid baths increases the evaporation rate at the air-liquid interface of the baths. Increased evaporation leads to increased heat loss which means that more heat must be supplied to the acid baths in order to maintain the acid baths at a constant temperature. Maintaining the acid baths at a constant temperature is important in achieving even pickling of a length of steel product.

To the end of minimizing heat loss and achieving efficiency, tank cover 6 separates the surface of the acid baths in pickle tank 4 from exhaust gas flow through the pickling system. This separation reduces the acid evaporation rate which reduces heat loss and provides for a more efficient control over the exhaust gases.

Figure 2:
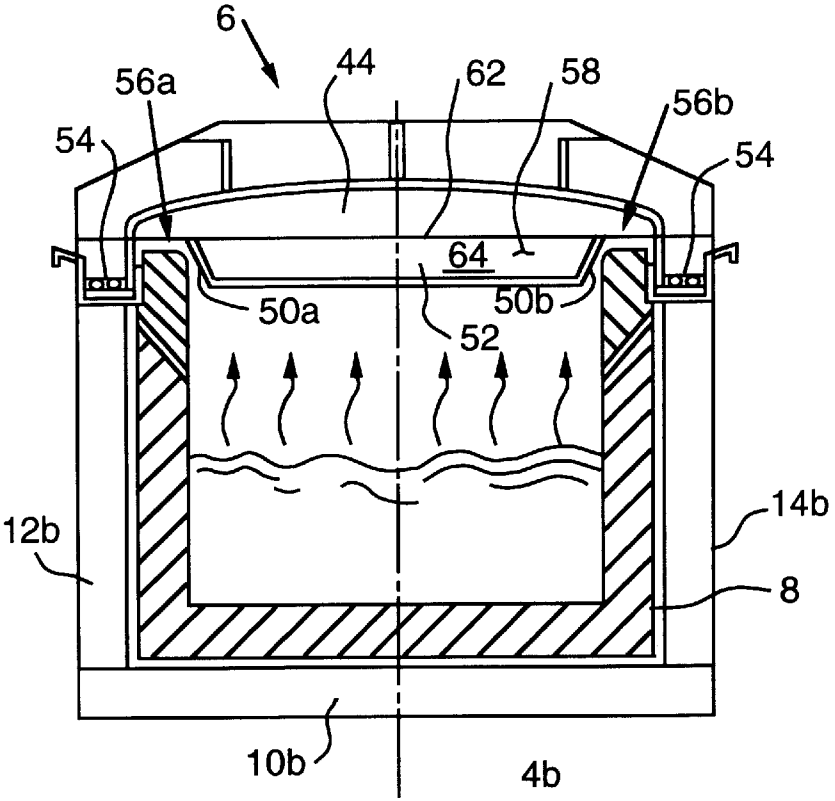
FIG. 2 is a schematic view, in cross-section, of one pickle tank and tank cover along section line Y—Y.

FIG. 1 shows pickle tank 4 of one embodiment comprising three acid pickle tanks 4*a, b, c* aligned in a series. Any number of pickle tanks may be used depending on the constraints of the system and amount of pickling desired. Each pickle tank 4*a, b, c* is constructed of polyprolene or steel lined with acid brick or granite 8 as shown in FIG. 2, a cross section taken along section line Y—Y. Between the steel and acid brick 8 there may be a rubber or plastic layer (not shown). Each pickle tank 4*a, b, c* has a bottom surface 10*a, b, c*, sidewalls 12*a, b, c*, and 14*a, b, c* respectively.

Pickle tank 4*a* has a front wall 16 at the entrance 18 of the pickling system. Front wall 16 has an inlet roller 20, for feeding steel strip 2, in front of a lip 22, shown in more detail in FIG. 4. Pickle tank 4*a* has a back wall 24, which joins a front wall 26 of pickle tank 4*b* to form an intermediate wall in pickle tank 4. Pickle tank 4*b* has a back wall 28 which joins a front wall 30 of pickle tank 4*c* to form another intermediate wall in pickle tank 4. Pickle tank 4*c* has a back wall 32 which forms an exit 34 of the pickling system along with an outlet roller 36.

Referring to FIG. 1, steel strip 2 enters pickle tank 4 by being fed over inlet roller 20 and over lip 22 of front wall 16 of pickle tank 4*a*. Steel strip 2 dips through the acid bath in pickle tank 4*a* and over a granite skid cap or a pair of intermediate rollers (not shown) provided in pickle tank 4*a* and over another granite skid cap or rollers (not shown) at the junction of each of pickle tanks 4*a*, 4*b*, 4*c*. Steel strip 2 then passes over back wall 32 of pickle tank 4*c* and contacts outlet roller 36 upon its exit from the pickling system.

Tank cover 6 in FIG. 1 extends the length of pickle tank 4 from steel strip inlet 18 at pickle tank 4*a* to steel strip exit 34 at pickle tank 4*c*. Tank cover 6 is made of a plurality of sections which when connected form a continuous tank cover 6 enclosing pickle tank 4. Tank cover 6 is constructed of a plurality of exhaust sections 38 each having an exhaust outlet 40 and a plurality of sections 42 which adjoin each other and sections 38. The number of sections that form a complete tank cover will vary depending on the length of the pickle tank and the length of each section. Tank cover 6, the preferred embodiment of the present invention, has four (4) exhaust sections 38 and six (6) sections 42. Tank cover 6 is preferably constructed so that exhaust sections 38 form the entrance and exit of a pickling system, in addition to being spaced evenly along tank cover 6, in between sections 42. Since exhaust sections 38 are associated with an external exhaust system and scrubber, they are not normally moved or lifted from pickle tank 4. Sections 42 are more easily lifted making their removal for access to pickle tank 4 more appropriate.

Figure 3:
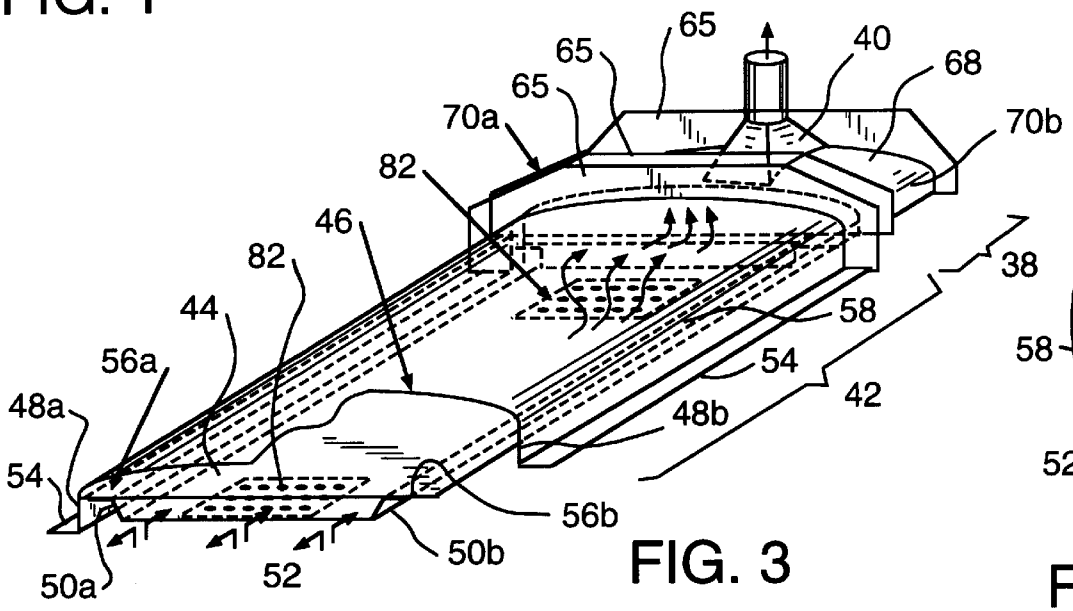
FIG. 3 is a perspective view of part of a tank cover showing a section having a plenum and an exhaust section.

Shown in FIG. 3 is the preferred embodiment of one exhaust section 38 and one section 42 of tank cover 6. Section 42 has an internal cavity 44 formed from a bowed roof or top wall 46, a first set of two depending side walls 48*a, b* extending downwardly from the longitudinal edges of top wall 46, a second set of depending sidewalls 50*a, b* connected to and extending downwardly from sidewalls 48*a, b* respectively and a solid bottom wall 52 in between and connecting the second set of side walls 50*a, b*.

Internal cavity 44 houses the structural elements, described below, of tank cover 6. Except for the main structural elements, internal cavity 44 does not communicate with rest of the pickling system. The hollow space of internal cavity 44 may be filled with air.

In the preferred embodiment, internal cavity 44 is disposed within a space created by bottom wall 10*a, b, c* and side walls 12*a, b, c* and 14*a, b, c* of pickle tank 4. Internal cavity 44 may be disposed within the space of pickle tank 4 so that bottom wall 52 of plenum chamber 58 is less than 12 inches from the surface of the acid bath in pickle tank 4. The relative sizes of plenum chamber 58, internal cavity 44 and exhaust section 38, for example, may be made larger or smaller than the relative sizes shown.

Section 42 covers a section of pickle tank 4 by mounting the first set of depending side walls 48*a, b* of section 42 on top of a section of sidewalls 12*a, b, c* and 14*a, b, c* of pickle tank 4. In the preferred embodiment, section 42 is mounted such that the first set of depending side walls 48*a, b* meet with sidewalls 12*a, b, c* and 14*a, b, c* allowing side walls depending from side walls 48*a, b*, namely 50*a, b*, to extend freely in space created between the acid bath in-pickle tank 4 and top wall 46 of section 42. In the preferred embodiment the second set of depending side walls 50*a, b* do not contact sidewalls 12*a, b, c* and 14*a, b, c* of pickle tank 4.

The first set of depending side walls 48*a, b* run parallel to each other and typically have a skirt 54 at the bottom of each side wll 48*a, b* for mounting on top of a side wall 12*a, b, c* and 14*a, b, c* of any one of pickle tank 4*a, b, c*, as shown clearly in FIG. 2. A liquid may provide the seal between skirt 54 and the top of sidewall 12*a, b, c* and 14*a, b, c*. A liquid seal or other type of seal that provides for thermal expansion would be preferred.

As previously mentioned, depending from side walls 48*a, b* are side walls 50*a, b* respectively which also run parallel to each other. Each depending side wall 50*a, b* depends directly from a member 56*a, b* respectively connected to each depending side wall 48*a, b*. Members 56*a, b* extend in the direction of internal cavity 44 from depending side walls 48*a, b*. Depending side walls 50*a, b* are narrower in width than depending side walls 48*a, b* so that depending side walls 50*a, b* may extend into pickle tank 4 below the top of side walls 12 and 14.

Connecting depending side walls 50*a, b* is solid bottom wall 52. Solid bottom wall 52 is both the bottom wall of internal cavity 44 of section 42 and the bottom wall of a plenum chamber 58, a separate structure, formed in internal cavity 44. Plenum chamber 58, shown in cross-section midway along the length of section 42 in FIG. 2, is formed by top wall 62, depending side walls 50*a* and 50*b* and bottom wall 52. Bottom wall 52, side walls 50*a* and 50*b* and top wall 62 form an enclosed space 64 which is plenum chamber 58.

Plenum chamber 58 is for collecting evaporated acid fumes and transporting these fumes to exhaust outlets 40 which are connected to exhaust section 38. The arrows in FIG. 3 represent the flow of exhaust gases from plenum chamber 58 through exhaust section 38 to exhaust outlet 40. The separate collection and transportation of exhaust gases in plenum chamber 58 does not disturb the air-liquid interface of the acid bath, which reduces the liquid evaporation rate at the acid bath surface which minimizes heat loss in the pickling system. Additionally, the rate of exhaust of exhaust gas from the system may be increased by increasing the flow rate of exhaust gas through plenum chamber 58, because plenum chamber 58 is an enclosed chamber within internal cavity 44 of section 42. Increasing flow rate of exhaust gasses would normally cause excessive acid evaporation if there was no exhaust gas—acid bath separation.

In the preferred embodiment, plenum chamber 58 has a rectangular shape at cross section Y—Y however, other shapes are possible.

As shown in FIG. 1. section 42 may be connected to another similar section 42 as well as to exhaust section 38. Exhaust section 38 is connected to exhaust outlet 40 further connected to an external scrubber. In the preferred embodiment, exhaust outlet 40 is positioned on the center of a top wall 68, although it may occupy any position on top wall 68. Exhaust section 38 may have external support ribs 65 as shown in FIG. 3. Support ribs 65 help maintain the structure of section 38.

Figure 4:
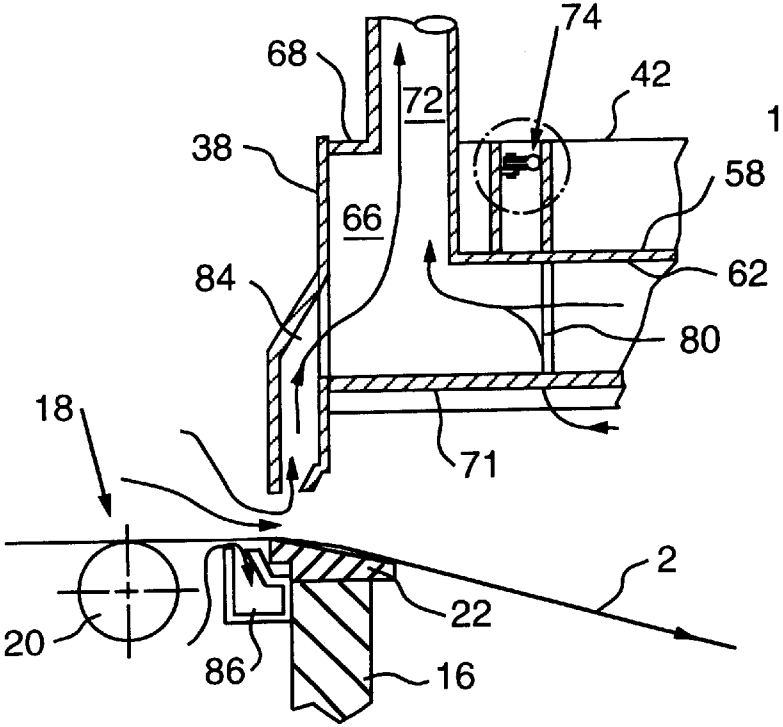
FIG. 4 is a schematic view, in cross-section, of one pickle tank and tank cover along section line A—A.

FIG. 4 illustrates the main internal elements of exhaust section 38 at the entry or exit to the pickling tanks. In the preferred embodiment, exhaust section 38 has an internal space 66 created by a bowed roof or top wall 68, two parallel side walls 70*a, b* depending therefrom and a solid bottom wall 71, with the profile of the aforementioned walls matching the profile of the corresponding walls of abutting section 42 as shown in FIGS. 3 and 4. In other words, the shape of the cross-section of top wall 68 is the same as shape as that of top wall 46 of section 42. The other walls have the same cross-sectional shape for a matching fit when section 42 abuts exhaust section 38.

The internal space 72 of exhaust outlet 40 cooperates with the internal space 66 of exhaust section 38 which cooperates with the enclosed space 64 of plenum chamber 58 of section 42. When tank cover 6 is assembled there is at least one enclosed space extending from tank inlet 18 to tank exit 34 created by the association of plenum chamber 64 in all sections 42 with internal space 66 of all exhaust sections 38 which is further associated with internal space 72 of all exhaust outlets 40. Tank cover 6 could be designed with more than one internal plenum chamber.

Inside the enclosed space extending from tank inlet 18 to tank exit 34 exhaust gases collect and may be transported to and discharged from exhaust outlets 40. As previously mentioned the enclosed space within tank cover 6 of the present invention separates the surface of the acid baths in pickle tank 4 from exhaust gas flow through the pickling system. This separation reduces the acid evaporation rate which reduces heat loss and provides for a more efficient control over the exhaust gases. It should be noted however that only a minimum of exhaust gases and air should be removed from the pickling operation. The less removal of gases the more energy conserved.

Figure 5:
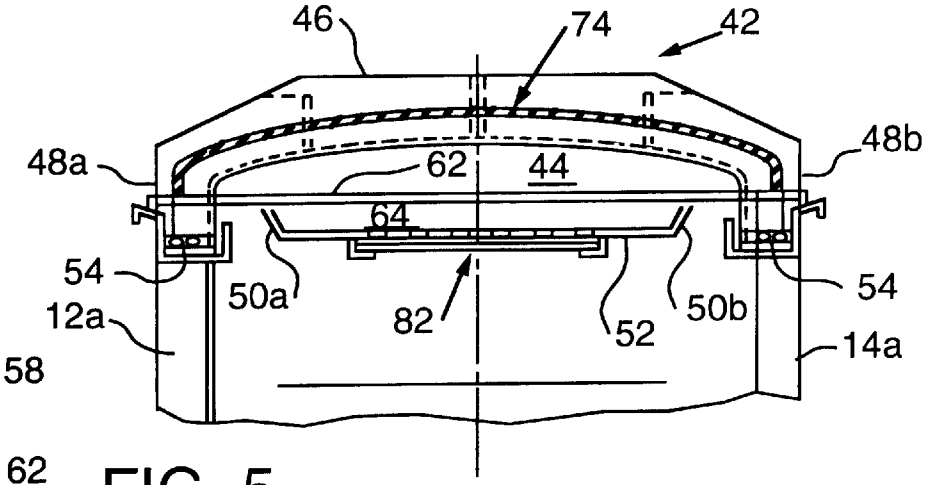
FIG. 5 is a schematic view, in cross-section, of one pickle tank and cover along section line Z—Z.

The junctures between any two sections 38 and 42 of tank cover 6 are preferably sealed so that no exhaust gases from the inside of the pickling system escape to the outside. In the preferred embodiment, a flexible seal 74 is disposed along the perimeter of the top wall and depending side walls of any two sections 38 and 42 to close the inside of the pickling system from the outside. FIG. 4 illustrates a joint between an exhaust section 38 and a section 42 while FIG. 5 is a cross-section (section Z—Z) of a section 42 taken where the section 42 abuts another section 42. In FIG. 5, the location of the flexible seal 74 is shown along the perimeter of top wall 46 and depending side walls 48*a, b*. The flexible seal 74, which is the same as the seal means used between sections 38 and 42, is connected to a holding member 76 further connected to a support member 78, as shown clearly in FIG. 6. Flexible seal 74 is preferably a flexible material that can withstand degradation by exposure to acid fumes and acid liquid. Flexible seal 74 may be neoprene rubber for example.

Figure 7:
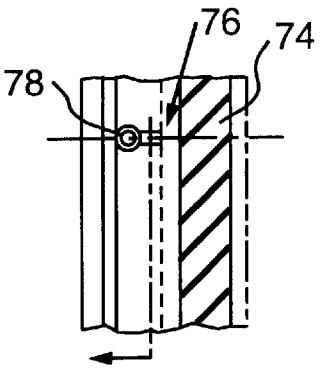
FIG. 7 is a sectional view of the sealing means.
Figure 6:
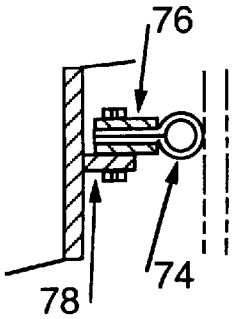
FIG. 6 is a schematic view, in cross-section, of the sealing means between the plenum chamber section and the exhaust section.

FIG. 7 is a top view of the flexible seal shown in FIGS. 4 and 6. FIG. 7 illustrates a tight fit between flexible seal 74 and abutting section 42.

While the top walls and side walls depending therefrom of any two sections 38 and 42 abut with no gap at their juncture, the internal spaces of the two sections, namely space 66 and plenum chamber 58 respectively, are not likewise connected in the preferred embodiment, leaving a gap 80 between them, which is ¼ inch at the maximum and preferably 1/16 inch think. Gap 80 is located at the junction of any two sections. Gap 80 cooperates with the inside of pickle tank 4 and the enclosed space of tank cover 6. Acid fumes evaporate from the acid baths in pickle tank 4 and rise (see arrows in FIG. 2 and FIG. 9) until they eventually rise into one of gaps 80 between any two sections 38 and 42. Exhaust gases enter gap 80 where they collect and join the stream of air and exhaust gases traveling through the enclose space of tank cover 6, extending from tank inlet 18 to tank exit 34, to be discharged out exhaust outlets 40. Because exhaust fumes enter plenum chamber 58 at gaps 80 located at the junctures of sections 38 and 42, fume removal is limited to specific locations which also helps minimize heat loss.

At the juncture of any two sections 38 and 42, gaps 80 preferably extends the width of bottom wall 52 of section 42 because plenum chamber 58 also preferably extends the width of bottom wall 52. Plenum chamber 58 could be positioned so that it does not extend the entire width of bottom wall 52 of section 42. Instead, in another embodiment, plenum chamber 58 may be located to one side of pickle tank cover 6.

As previously mentioned gap 80 provides one opening area for the collection of fumes that evaporate from the acid bath in pickle tank 4. In addition to this gap 80 at the juncture of any two tank sections 38 and 42 are adjustable orifice plates 82 located on bottom wall 52 of section 42. Adjustable orifice plate 82, illustrated clearly in FIG. 3, allows for the additional collection of fume gas as well as the balance of air in the fume transport system in plenum chamber 58. Orifice plates 82 are used if the inside vapor pressure is to great causing fumes to escape out of the cover junctions or if a seal fails. Orifice plates 82 can be adjusted so the static pressure is the same at each exhaust outlet 40 so movement of air across the bath surface is minimized.

FIG. 5 illustrates the cross section of pickle tank 4 and tank cover 6 at section line Z—Z. The cross section shows that plenum chamber 58 extends along the entire bottom wall 52 of tank cover 6 and almost the entire width of acid pickle tank 4. The plenum chamber 58 spans almost the complete pickle tank 4 width in order to capture any fumes evaporating from the acid bath surface. It also serves the purpose that if any cover section 42 is lifted from acid tank 4 then the fume exhaust section 38 will capture all of the fumes across the entire tank width. When this happens, the system is increased in capturing capacity. The fumes will be transported through plenum chamber 64 to exhaust section 38 where they will discharge through exhaust outlet 40. After tank cover section 42 is removed, of course, the exhaust system will no longer be a relatively closed system but will contain a gap in which exhaust fumes may escape.

Another feature of tank cover 6 of the present invention are the air inlet sections at the entrance 18 and exit 34 of tank cover 6 designed to minimize escape gases from the pickling system. When tank cover 6 is fully assembled no air can escape through the top of tank cover 6. A small amount of air will enter the pickle tank system at inlet 18 and outlet 34 shown in FIG. 1. To prevent the escape of exhaust fumes a small inlet duct 84 extends down from exhaust section 38, shown in detail in FIG. 4. Inlet duct 84 is associated with the exhaust system so that air entering the pickling system is drawn into inlet duct 84 and discharged through exhaust outlet 40. This flow of air into the inlet duct 84 forms an air curtain to prevent the escape of exhaust gases from the pickle tank 4. Also to prevent air from entering the pickle tank system from below the steel strip, a small air flow chamber 86 is constructed just under lip 22 of end wall 16 at both the inlet 18 and exit 34 as shown in FIG. 1. Air flow chamber 86 works in concert at the ends with air flow chamber 84 to allow exhaust discharge through exhaust outlet 40.

Figure 8:
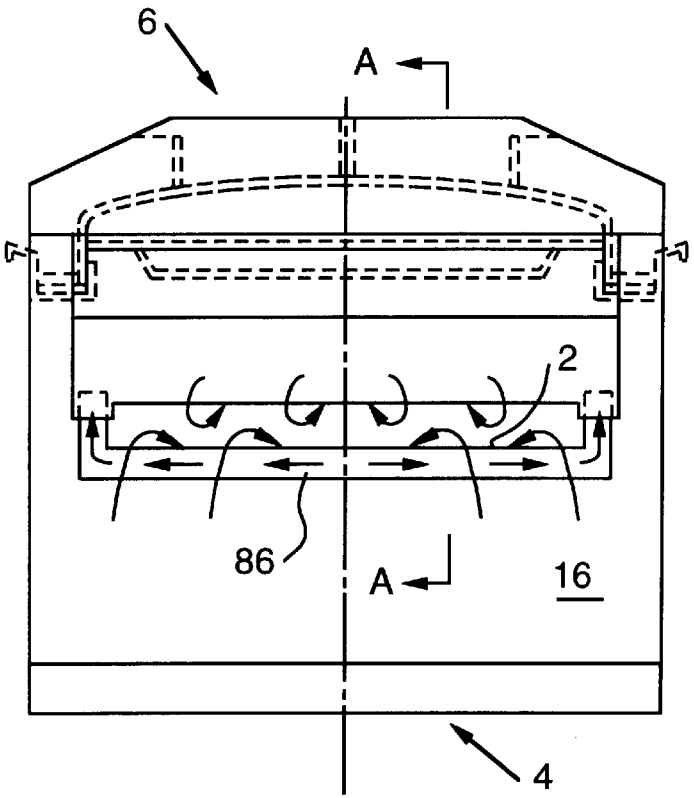
FIG. 8 is a schematic view, in cross-section, of the pickle tank and tank cover of the present invention along view line X—X.

FIG. 8 a view in cross-section taken along line X—X shows this flow of air around the steel strip into inlet duct 84 and air flow chamber 86 around the steel strip entering pickle tank 4*a*.

Figure 9:
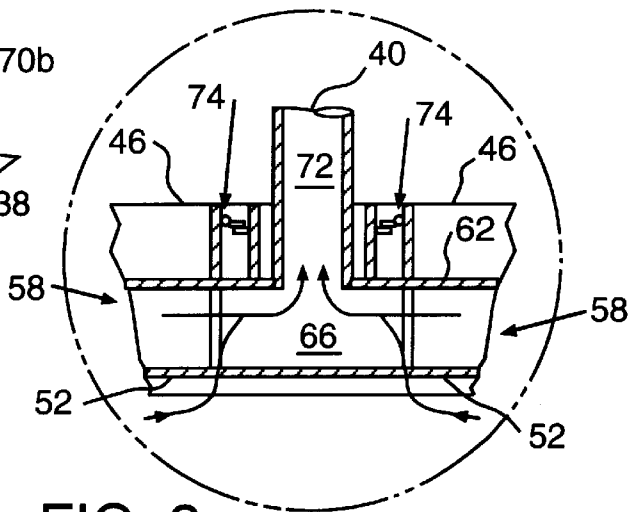
FIG. 9 is a cross-section of the joint between the exhaust section and section with the plenum chamber of the tank cover.

FIG. 9 is a cross-section of the joint between exhaust section 38 and section 42 of tank cover 6. The arrows represent the flow of exhaust gases through tank cover 6 and pickle tank 4.

The preferred method of pickling a length of metal strip is as follows:

providing a pickle tank having a bottom wall, end walls and side walls for containing an acid bath for pickling metal strip; providing a means for introducing metal strip over one end wall of the tank, passing the metal strip through the acid bath and over an opposite end wall of the tank; providing a pickle tank cover substantially completely covering the pickle tank and acid bath and having a top wall, bottom wall end wall and side walls thereby creating an internal cavity and an exhaust means connected to the top wall; forming a plenum chamber in the internal cavity of the pickle tank cover, communicating with the exhaust means and disposed within the space formed by the side walls and bottom wall of the pickle tank; directing vapors from the acid bath to the plenum chamber; and exhausting the vapors out of the plenum chamber to the exhaust means.

Thus the design of the entire pickle tank cover provides a separation of exhaust gases from the air liquid interface of the acid bath as well as improves air flow along the exhaust system including an increased rate of exhaust and provides for the capture of exhaust gases at the inlet and outlet providing for a more efficient use of the air. Additionally this unique design allows for the capture of gases along the entire width of the acid tank and the transportation of these fumes in a relatively closed system to exhaust outlets at certain intervals along the tank.

While there has been illustrated and described several embodiments of the present invention, it will be apparent that various changes and modifications thereof will occur to those skilled in the art. It is intended in the appended claims to cover all such changes and modifications that fall within the true spirit and scope of the present invention.

What is claimed is:

1. An improved cover for containment and exhaust of fumes from an acid bath in a pickling line having, a) a pickle tank having a bottom wall, end walls and side walls for containing an acid bath for pickling metal strip;

b) means for introducing metal strip over one end wall of the tank, passing the metal strip through the acid bath and over an opposite end wall of the tank;

said improved cover, substantially completely covering the pickle tank and acid bath, and comprising:

a top wall;

side walls depending from the top wall which include a means to support the cover on the side walls of the pickle tank;

end walls at each end of the cover depending from the top wall and forming a gap with the end walls of the pickle tank to permit the introduction or exit of metal strip;

a bottom wall connecting the depending side walls and forming an internal cavity bounded by the top wall, the side walls and the bottom wall of the cover;

a plenum chamber formed in said internal cavity and sharing at least a bottom wall with the cover and extending from one end wall of the cover to approximately the opposite end wall of the cover; and at least one exhaust means mounted on the cover and communicating with the plenum chamber, whereby evaporating fumes from the acid bath are confined to the plenum chamber and exhausted from the pickle tank.

2. The improved cover of claim 1, wherein said internal cavity of said improved cover is disposed within a space formed by the side walls and bottom wall of the pickle tank.

3. The improved cover of claim 1, wherein the plenum chamber has at least one orifice plate on the bottom wall of said chamber to allow for adjusting the collection of evaporated fumes from the acid bath.

4. The improved cover of claim 1, wherein at least one air duct having an open end directed to said gap formed between the end wall of the cover and the end wall of the pickle tank and an opposite end in communication with the open end and an exhaust system, is positioned on at least one of the end walls of the cover for drawing in, from outside the pickle tank, air surrounding the metal strip as it enters and exits the pickle tank.

5. The improved cover of claim 1, wherein at least one air chamber having an open end directed to said gap formed between the end wall of the cover and the end wall of the pickle tank and an opposite end in communication with the open end and an exhaust system, is positioned on at least one of the end walls of the pickle tank for drawing in air surrounding the metal strip as it enters and exits the pickle tank.

6. An improved cover for containment and exhaust of fumes from an acid bath in a pickling line having, a) a pickle tank having a bottom wall, end walls and side walls for containing an acid bath for pickling metal strip;

b) means for introducing metal strip over one end wall of the tank, passing the metal strip through the acid bath and over an opposite end wall of the tank;

said improved cover having a plurality of adjoining sections, substantially completely covering the pickle tank and acid bath, comprising:

at least one plenum section further comprising, a top wall;

side walls depending from the top wall which include a means to support at least one plenum section on the side walls of the pickle tank;

a bottom wall connecting the depending side walls and forming an internal cavity bounded by the top wall, the side walls and the bottom wall of at least one plenum section;

a plenum chamber formed in said internal cavity and sharing at least a bottom wall with at least one plenum section and extending from one end wall of the cover to approximately the opposite end wall of the cover; and at least one exhaust section further comprising, a top wall;

side walls depending from the top wall which include a means to support at least one exhaust section on the side walls of the pickle tank;

a bottom wall connecting the depending side walls and forming an internal cavity bounded by the top wall, the side walls and the bottom wall of at least one exhaust section;

at least one exhaust means mounted on at least one exhaust section and communicating with the plenum chamber of the plenum section; and end walls at each end of the cover depending from the top wall of either at least one plenum section or at least one exhaust section and forming a gap with the end walls of the pickle tank to permit the introduction or exit of metal strip;

whereby evaporating fumes from the acid bath are confined to the plenum chamber of at least one plenum section and exhausted from at least one exhaust section of the pickle tank.

7. The improved cover of claim 6, wherein said internal cavity of at least one plenum section and at least one exhaust section is disposed within a space formed by the side walls and bottom wall of the pickle tank.

8. The improved cover of claim 6, wherein at least one plenum chamber of the plenum section has at least one orifice plate on the bottom wall of said chamber to allow for the collection of evaporated fumes from the acid bath.

9. The improved cover of claim 6, wherein a seal is disposed between at least one adjoining plenum section and at least one adjoining exhaust section or between like sections, for inhibiting the escape of exhaust gases from the pickle tank.

10. The improved cover of claim 9, wherein the seal is made of neoprene rubber.

11. The improved cover of claim 6 wherein gaps are formed at the location where the plenum chamber of at least one plenum section joins at least one exhaust section and the location where the plenum chamber of at least one plenum section joins the plenum chamber of at least one other plenum section.

12. The improved cover of claim 6, wherein at least one air duct having an open end directed to said gap formed between the end wall of the cover and the end wall of the pickle tank and an opposite end in communication with the open end and an exhaust system, is positioned on at least one of the end walls of the cover for drawing in air surrounding the metal strip as it enters and exits the pickle tank.

13. The improved cover of claim 6, wherein at least one air chamber having an open end directed to said gap formed between the end wall of the cover and the end wall of the pickle tank and an opposite end in communication with the open end and an exhaust system, is positioned on at least one of the end walls of the pickle tank for drawing in air surrounding the metal strip as it enters and exits the pickle tank.

* * * * *